US005159762A

United States Patent [19]

Sakakibara

[11] Patent Number: 5,159,762

[45] Date of Patent: Nov. 3, 1992

[54] REGULATING RULE FOR GRAND PIANOS

[75] Inventor: Noriyuki Sakakibara, Hamana, Japan

[73] Assignee: Kawai Gakki Seisakusho Co., Ltd., Hamamatsu, Japan

[21] Appl. No.: 814,698

[22] Filed: Dec. 30, 1991

[30] Foreign Application Priority Data

Jan. 10, 1991 [JP] Japan ..... 3-69591

[51] Int. Cl.[5] ..... G10C 3/00

[52] U.S. Cl. ..... 33/832; 84/454; 84/458; 84/DIG. 18; 84/200

[58] Field of Search ..... 33/832, 833, 644, 679.1, 33/511; 84/454, 455, 458, 459, DIG. 18, 200

[56] References Cited

U.S. PATENT DOCUMENTS

| | | | |
|---|---|---|---|
| 3,183,761 | 5/1965 | Van Ooyeu | 84/454 |
| 3,353,434 | 11/1967 | Habig et al. | 84/454 |
| 3,667,336 | 6/1972 | Itzler et al. | 84/455 |
| 4,307,648 | 12/1981 | Stahnke | 84/462 |
| 4,452,122 | 6/1984 | Kovach | 84/455 |
| 5,065,660 | 11/1991 | deBuda | 84/454 |

*Primary Examiner*—William A. Cuchlinski, Jr.
*Assistant Examiner*—William C. Dowling
*Attorney, Agent, or Firm*—Jacobson, Price, Holman & Stern

[57] ABSTRACT

The present invention enables accurate measuring and regulating operations to be carried out by measuring with a rule the quantity of movement of a hammer in a grand piano during an action mechanism regulating operation for attaining the normal striking of wires with the hammer. The wires S provided in a tensed state are held between the lower surface of a mount 4 and a locking rod 3 on a measuring tube 2 pressure-contacting the same lower surface, and the lower end of a measuring rod slidingly moved in the measuring tube is placed on the top end of the hammer, the quantity of movement of the hammer being then read directly with reference to the relative positions of a scale mark 8 shown on the measuring rod 1 and the upper end of the measuring tube 2.

4 Claims, 3 Drawing Sheets

REGULATING RULE FOR GRAND PIANOS

BACKGROUND OF THE INVENTION

1. Field of the Invention

This invention relates to a rule for regulating an action mechanism in a grand piano.

2. Description of the Prior Art

In general, a piano is constructed so as to produce a sound by striking a wire, which is provided in a tensed state on a frame, with a hammer via an action mechanism in accordance with a key pressing operation. One action mechanism is provided correspondingly to one key. In order to normally operate an action mechanism in accordance with the pressing of the relative key and strike the wire with the hammer, an operation called "regulation" in which each action mechanism is regulated is necessarily carried out. This operation includes:

(1) Regulation of a hammer stroke for setting a distance between a hammer and a wire in a non-operating condition.

(2) Regulation of the starting of a damper for setting the time of starting the production of a sound at which a damper relative to a pressed key leaves a wire, and the time of ending the production of the sound at which the damper holds the wire.

(3) Regulation of hammer let-off in which a hammer is moved back from a position short of a wire when a key is pressed gently.

(4) Regulation of a hammer back stop for setting the position occupied by a hammer when a jack in an action mechanism returns, in such a manner that the hammer can strike repeatedly without trouble.

In all of these regulating operations, preset specified quantities based on the relating of relative positions of a hammer and the lower surface of a wire are provided. Since these regulating operations require perception and experience, they are carried out by a skilled technician called a tuner.

In order to carry out these regulating operations easily, a substantially E-shaped stroke rule V consisting of a metal material, such as a thick iron plate and shown in FIG. 4 is used. In this stroke rule V, the distances a, b, and c are set to the quantities of hammer stroke, hammer back stop and hammer let-off respectively. In order to regulate the quantity a of hammer stroke, the stroke rule V is placed so that the upper surface of a second member $V_2$ thereof and the lower surface of a first member $V_3$ thereof contact the lower surfaces of wires S and the upper end surface of a hammer H respectively as shown in FIG. 5. In order to regulate a hammer back stop, the stroke rule V is placed so that the first member $V_3$ is held between the lower surfaces of the wires S and the upper end surface of the hammer H so as to set the distance between these surfaces equal to the quantity b of hammer back stop. In order to regulate the hammer let-off, the stroke rule V is placed so that a third member $V_1$ thereof is held between the lower surfaces of the wire S and the upper end surface of the hammer H so as to attain the quantity c of hammer let-off. The action mechanism is thus regulated in accordance with the objects of the regulating operations.

Since the stroke rule V of this construction has specified quantities set thereon in accordance with each regulating operation, the action mechanism may be regulated so that these specified quantities are attained. However, in order to carry out a regulating operation, the stroke rule V cannot be placed on or fixed to the upper surfaces of the wires S, neither can the heavy rule be placed on the upper surface of a hammer in operation. Therefore, it is necessary that a tuner carries out measurement and the regulation of an action mechanism as he holds the rule in one hand and brings it into contact with the lower surfaces of the wires with a tool held in the other hand. This makes it difficult to carry out a regulating operation, and requires much time to carry out the same.

Since the rule is formed so that different specified quantities are determined by different portions thereof, the measuring portions of the rule have to be changed by moving the rule every time each measuring and regulating operation in the same-pitched sound section has been completed, and the rule has to be inserted between and removed from the wires S and hammer H each time. Namely, each measuring and regulating operation cannot be carried out by setting the rule once.

In the low-pitched sound section, a damper D is positioned just above the relative hammer H. Therefore, the damper obstructs the insertion of the stroke rule, so that a stroke rule setting operation and an action mechanism regulating operation becomes difficult and inaccurate respectively. Whenever there is a difference between a distance between a hammer not yet regulated and the relative wire and each specified quantity of the stroke rule, the quantity of the difference is measured with the eye. Consequently, an accurate quantity of the difference cannot be determined, and an accurate regulating operation depends upon the tuner's perception and experience.

SUMMARY OF THE INVENTION

The present invention aims at eliminating these drawbacks.

To achieve this object, the regulating rule for grand pianos according to the present invention is provided with a mount adapted to be placed on wires extending in a tensed state, a measuring tube slidingly movable in the vertical direction through the mount, a substantially L-shaped measuring rod slidingly movable in the vertical direction through the measuring tube, and a pressure means urging the measuring tube so that the lower end of the measuring tube constantly contacts the lower surface of the mount, the quantity of movement of the hammer being measured with the measuring rod placed on the upper end of the hammer with the wires held between the measuring tube and mount by the force of the pressure means.

In this regulating rule, the measuring rod is provided with graduations, and the graduations are painted in various colors.

The pressure means for urging the measuring tube against the mount in the regulating rule for grand pianos according to the present invention consists of a compressing spring through which the measuring tube is inserted.

The measuring tube in the regulating rule for grand pianos according to the present invention consists of a transparent non-metallic material.

According to the present invention, the rule can be placed on wires with the wires held between the mount and measuring tube by the force of the spring, and each measuring and regulating operation can be carried out accurately by reading the quantity of movement of the measuring rod with reference to the position of the upper end of the measuring tube. Each measuring and regulating operation can be carried out with the regulating rule set only once. Moreover, the graduations on the measuring rod in the transparent measuring tube can be read therethrough with reference to the position of the upper end of the measuring tube, so that an action mechanism regulating operation can be easily carried out.

DESCRIPTION OF THE PREFERRED EMBODIMENT

An embodiment of the present invention will now be described with reference to the drawings.

Figure 1:
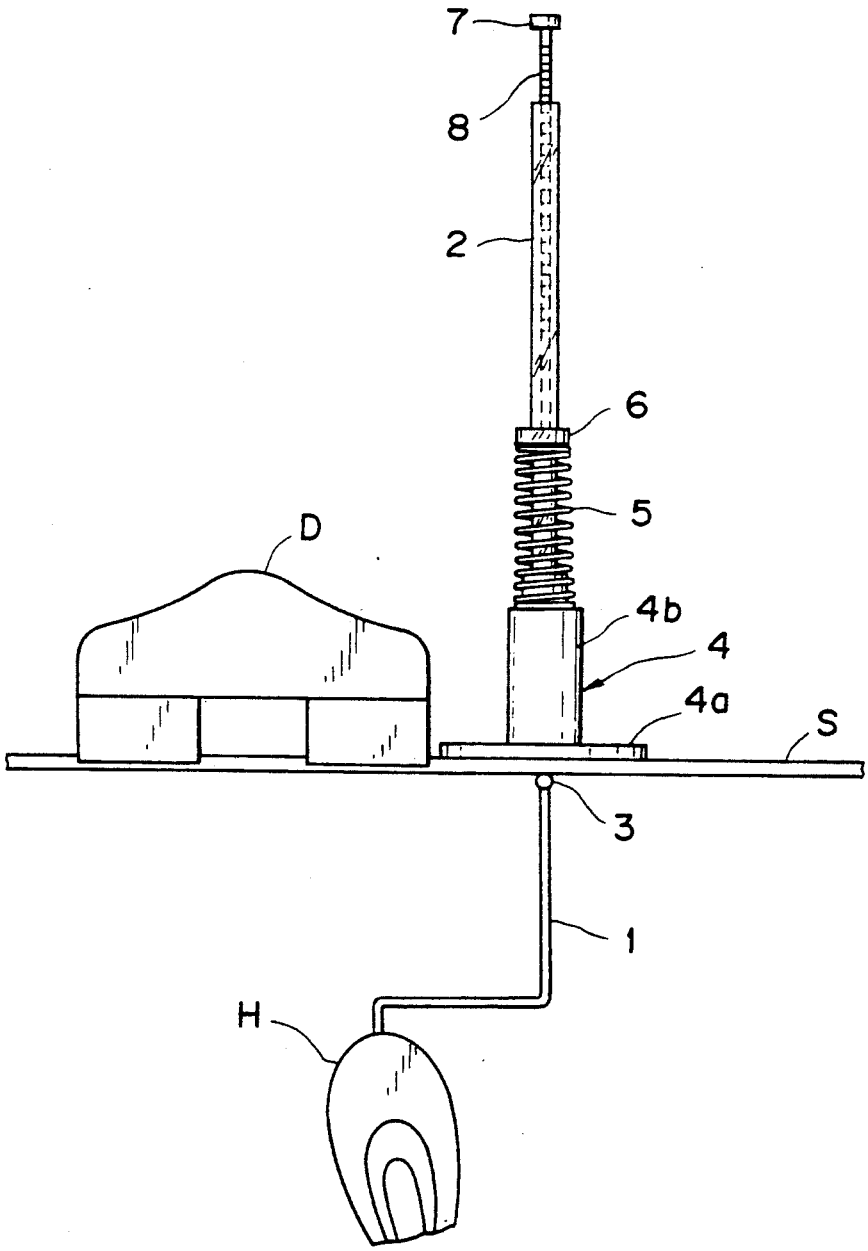
FIG. 1 is a side elevation of the regulating rule for grand pianos according to the present invention.
Figure 2:
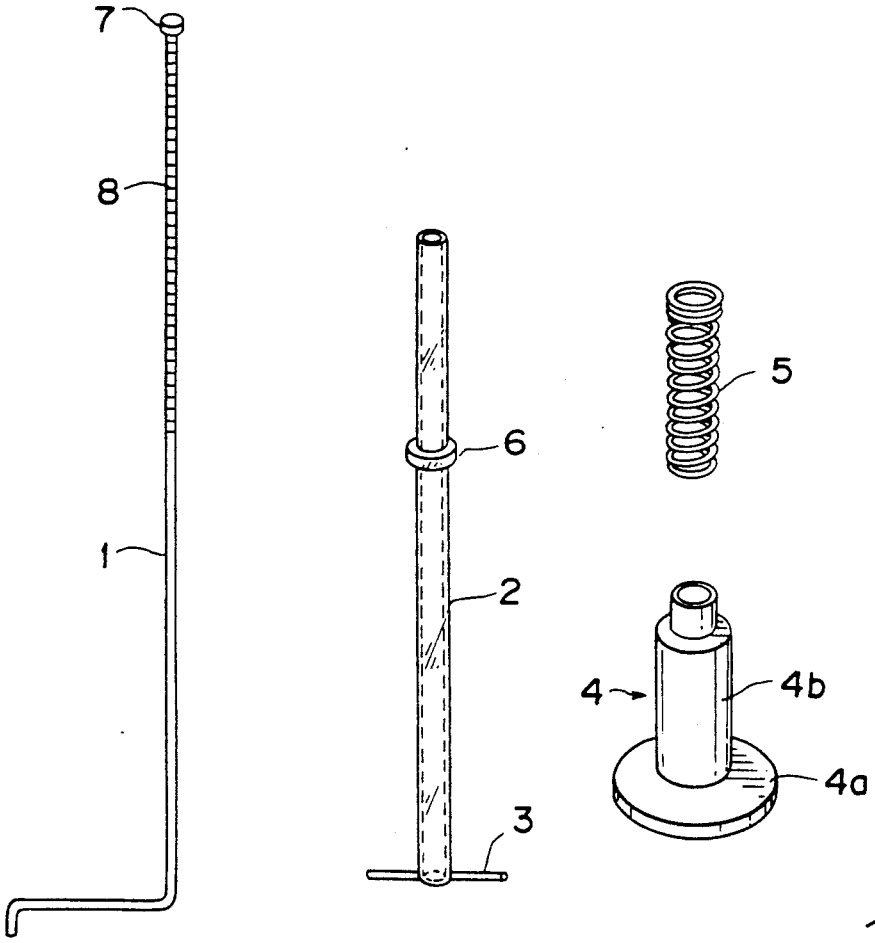
FIG. 2 is a perspective view showing the construction of each part of the regulating rule for grand pianos according to the present invention.

FIG. 1 is a side elevation of the rule for grand pianos according to the present invention, and FIG. 2 shows the construction of each part of this rule, in which a reference numeral 1 denotes a substantially L-shaped measuring rod of a small diameter which consists of a hard metallic material, such as a piano wire, and which is extended downward at the terminal end of the horizontally extending portion thereof, and a reference numeral 2 denotes a measuring tube consisting of a transparent plastic material and holding the measuring rod 1 vertically movable therein. A linear locking rod 3 is provided horizontally on the lower surface of a thick walled bottom portion of the measuring tube 2 so that the locking rod is opposed to and separately formed with respect to the thick walled bottom portion.

A reference numeral 4 denotes a mount for the rule, which has at the lower portion thereof a flange 4*a* with a cylinder 4*b*, through which the measuring tube 2 can be slidingly moved, formed integrally with the flange.

A reference numeral 5 denotes a spring the inner diameter of which is larger than the outer diameter of the meauring tube 2.

The measuring tube 2 is inserted into the mount 4 from the lower surface of the flange 4*a* thereof and urged by the spring 5 provided between the upper end of the cylinder 4*b* of the mount 4 and a fixing member 6 mounted firmly on the measuring tube 2 so that the measuring tube can be moved slidingly in the vertical direction with respect to the mount 4. The measuring tube 2 has the measuring rod 1 inserted thereinto from the lower side thereof, the measuring rod 1 being provided at the upper end thereof with a stopper 7 whereby the fall-off of the measuring rod 1 from the measuring tube 2 is prevented.

The measuring rod 1 has on the outer surface thereof graduations of positions which start at the portion thereof which is opposed to the upper end surface of the measuring tube 2, and which are required for an action mechanism regulating operation, these graduations being provided in millimeters. On the measuring rod, a range of 2–7 mm indicating the position of hammer let-off with respect to the lower side of the wires S, a range of 10–15 mm indicating the position of hammer back stop, a range of 18–23 mm indicating the starting position of damper and a range of 41–46 mm indicating the quantity of hammer stroke with respect to the lowermost portion of the hammer are painted in different colors.

Since a conventional stroke rule V is not provided with a projection indicating a specified quantity for a damper starting position regulating operation, the regulating operation is carried out with the eye or by using an ordinary rule so that, when a hammer has moved by ½ of the above-mentioned quantity of hammer stroke, the damper starts leaving the wires.

Figure 3:
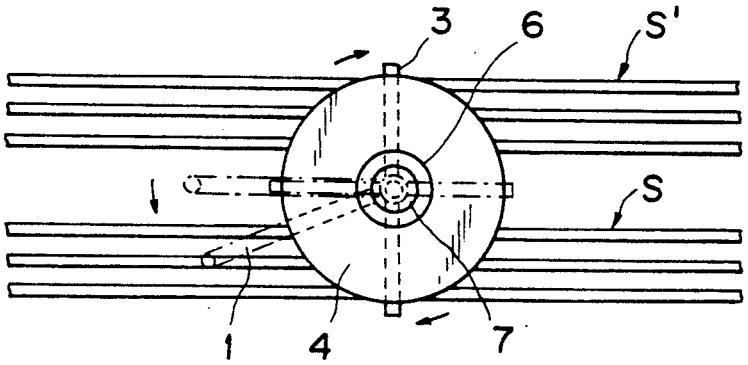
FIG. 3 is a plan view showing the measuring condition of the regulating rule for grand pianos according to the present invention.
Figure 4:
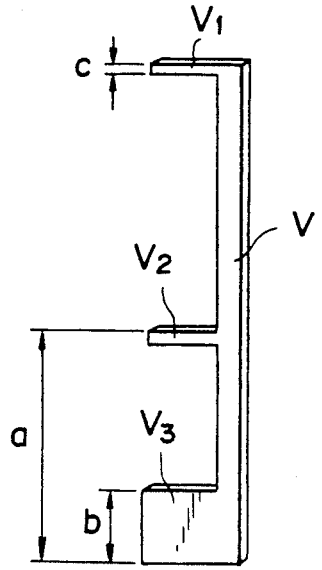
FIG.4 PRIOR ART
FIG. 4 is a perspective view of a conventional stroke rule.
Figure 5:
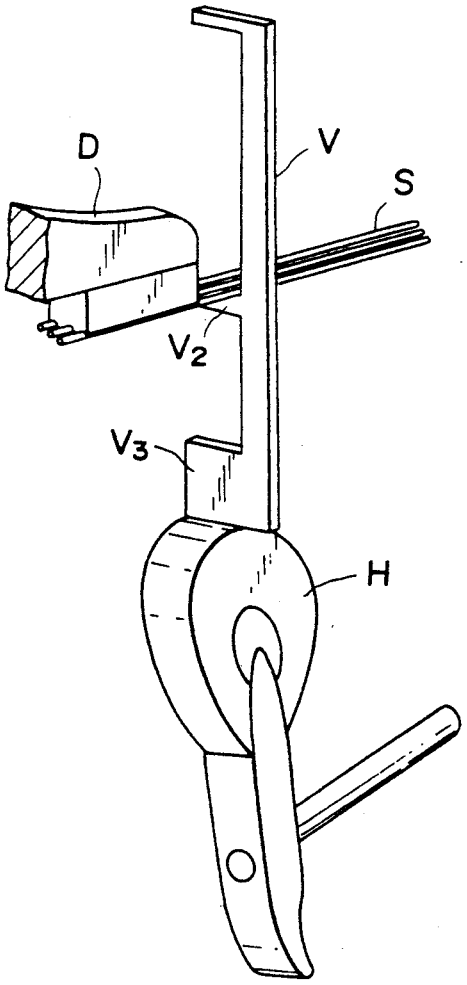
FIG.5 PRIOR ART
FIG. 5 is a perspective view showing a measuring method using the conventional stroke rule.

In order to use the rule according to the present invention, the mount 4 with the measuring rod 1 inserted between the wires S on an object hammer H and adjacent wires S' is placed on the same wires S, S' as shown in FIGS. 1 and 3, and the measuring tube 2 is pressed down, the locking rod 3 at the lower end of the measuring tube being then turned so as to hold the wires S, S' between the locking rod 3 and the flange 4*a* of the mount 4 by the force of the spring 5. When the rule is thus set, the position of the upper end, which constitutes a measurement reference, of the measuring tube 2 is determined on the basis of that of the lower surfaces of the wires S, so that the measuring operation is not influenced by a difference between the thickness of the wires S in a low-pitched sound section and that of the wires S in a high-pitched sound section.

The measuring rod 1 is then turned so as to place the vertical or horizontal portion thereof on the upper end of the hammer H, so that the measurement is completed.

The reason for placing the horizontal portion on the upper end of the hammer H is to avoid unadjustment caused by the touching of the end of the L-shaped measuring rod to the back beam and by the touching of the horizontal portion to the lower part of wire S in a hammer let-off regulation with the horizontal portion placed on the upper end of hammer H owing to the length (5 mm) of the vertical portion of the measuring rod 1. At this point, each measurement scale is colored differently in order to distinguish each other.

The measuring rod 1 consists of a small-diameter wire material. Accordingly, even when it is placed on a hammer H in operation, it does not adversely affect the operation of the hammer.

The measuring and regulating operations are carried out by reading the graduation on the measuring rod 1 with reference to the upper end of the measuring tube 2. When the reference position shown on the measuring rod 1 is higher than the upper end of the measuring tube 2 during each regulating operation, the quantity of a difference therebetween is directly read. When the reference position shown on the measuring rod 1 is lower than the upper end of the measuring tube 2, the quantity of a difference therebetween is read through the transparent measuring tube 2.

When using the regulating rule for grand pianos of the present invention described above, it is placed and fixed on the wires, and both hands of a tuner are free, so that the measuring and regulating operations can be carried out easily.

Since each measuring and regulating operation is carried out by reading the quantity of movement of the measuring rod, the regulating rule has only to be set once. In each measuring operation, a difference between an actual quantity of movement of the measuring rod and a specified quantity can be determined by directly reading the former, and accurate measuring and regulating operations can be carried out easily. Therefore, unlike the conventional stroke rule, the regulating rule according to the present invention requires no perception and experience and enables not only a tuner but also any other person to carry out an accurate regulating operation with ease. Thus, the effect of the present invention is very large.

What is claimed is:

1. A regulating rule for grand pianos, comprising a mount adapted to be placed on wires extending in a tensed state, a measuring tube which is provided at the lower end thereof with a locking rod engaged with the lower surface of said mount, and which is adapted to be moved slidingly in the vertical direction through said mount, a substantially L-shaped measuring rod slidingly movable in the vertical direction through said measuring tube, and a pressure means urging said measuring tube so that the lower end of said measuring tube constantly contacts the lower surface of said mount, the quantity of movement of a hammer being measured with said measuring rod placed on the upper end of said hammer with said wires held between said measuring tube and said mount by the force of said pressure means.

2. A regulating rule for grand pianos according to claim 1, wherein said measuring rod is provided thereon with graduations, different ranges of said graduations representative of specified quantities for different object regulating operations being painted in different colors.

3. A regulating rule for grand pianos according to claim 1, wherein said means for bringing said lower end of said measuring tube and said lower surface of said mount into pressure contact with each other consists of a compression spring put over said measuring tube so as to press the upper end of said mount.

4. A regulating rule for grand pianos according to claim 1, wherein said measuring tube consists of a transparent non-metallic material.

* * * * *